US012092377B2

(12) United States Patent
Edwards et al.

(10) Patent No.: US 12,092,377 B2
(45) Date of Patent: Sep. 17, 2024

(54) THERMOELECTRIC REFRIGERATED/FROZEN PRODUCT STORAGE AND TRANSPORTATION COOLER

(71) Applicant: Phononic, Inc., Durham, NC (US)

(72) Inventors: Jesse W. Edwards, Wake Forest, NC (US); Abhishek Yadav, Cary, NC (US); Devon Newman, Salt Lake City, UT (US); Austin J. Lewis, Durham, NC (US); Simbarashe Nyika, Durham, NC (US); Mattias Olsson, Cary, NC (US); Edward Joseph Karwacki, Garner, NC (US); Frank Holton, Morrisville, NC (US)

(73) Assignee: Phononic, Inc., Durham, NC (US)

( * ) Notice: Subject to any disclaimer, the term of this patent is extended or adjusted under 35 U.S.C. 154(b) by 0 days.

(21) Appl. No.: 17/135,420

(22) Filed: Dec. 28, 2020

(65) Prior Publication Data

US 2021/0199353 A1 Jul. 1, 2021

Related U.S. Application Data

(60) Provisional application No. 62/953,771, filed on Dec. 26, 2019.

(51) Int. Cl.

| | |
|---|---|
| ***F25B 21/04*** | (2006.01) |
| ***B65D 81/18*** | (2006.01) |
| ***B65D 81/38*** | (2006.01) |

(52) U.S. Cl.

CPC ..... *F25B 21/04* (2013.01); *B65D 81/18* (2013.01); *B65D 81/3813* (2013.01)

(58) Field of Classification Search

CPC ... F25B 21/04; F25D 11/033; B65D 81/3813; B65D 81/18

See application file for complete search history.

(56) References Cited

U.S. PATENT DOCUMENTS

| | | | |
|---|---|---|---|
| 5,572,873 | A | 11/1996 | Lavigne et al. |
| 6,729,144 | B1 | 5/2004 | Kupferman |

(Continued)

FOREIGN PATENT DOCUMENTS

| | | | |
|---|---|---|---|
| EP | 0495463 | A2 | 7/1992 |
| EP | 1564514 | A1 | 8/2005 |

(Continued)

OTHER PUBLICATIONS

International Search Report and Written Opinion for International Patent Application No. PCT/US2020/067172, mailed Apr. 19, 2021, 13 pages.

(Continued)

*Primary Examiner* — Elizabeth J Martin

(74) *Attorney, Agent, or Firm* — Withrow + Terranova, PLLC

(57) ABSTRACT

Systems and methods for thermoelectric refrigerated/frozen product storage and transportation are provided. A cooler includes active thermoelectric cooling to maintain internal temperature within cold chain or customer requirements. The active cooler can be used for storage and transportation of refrigerated and frozen food stuffs, medical or biological products, etc. The active cooler maintains stable and uniform temperature control. A drop in module (e.g., removable/replaceable) can convert any insulated box to active cooling. This can be a commercial transport tote that provides high efficiency. The control logic can be enabled as an API to offer remote monitoring/control to utilize on board, wireless, and networked. A use profile can be customized, and a subscription software package can enable this. The (Continued)

solutions described herein can be used across the whole commercial spectrum and can be ready to integrate into large quantity fleet systems.

14 Claims, 5 Drawing Sheets

(56) References Cited

U.S. PATENT DOCUMENTS

| | | | | |
|---|---|---|---|---|
| 9,144,180 | B2 | 9/2015 | Olsson et al. | |
| 9,581,362 | B2 | 2/2017 | Stanley et al. | |
| 9,593,871 | B2 | 3/2017 | Stanley et al. | |
| 10,458,683 | B2 | 10/2019 | Edwards et al. | |
| 2005/0061877 | A1 | 3/2005 | Stevens | |
| 2007/0119187 | A1 | 5/2007 | Kitchens et al. | |
| 2013/0291555 | A1 | 11/2013 | Edwards et al. | |
| 2015/0075184 | A1 | 3/2015 | Edwards et al. | |
| 2015/0330703 | A1 | 11/2015 | Satou et al. | |
| 2017/0363349 | A1 | 12/2017 | McHale et al. | |
| 2018/0164034 | A1 | 6/2018 | Banks | |
| 2019/0003757 | A1 | 1/2019 | Miros et al. | |
| 2019/0323756 | A1* | 10/2019 | Alexander | F25B 21/02 |
| 2020/0256593 | A1* | 8/2020 | Spath | F25D 29/003 |
| 2021/0364217 | A1* | 11/2021 | Ahmed | F25D 17/02 |

FOREIGN PATENT DOCUMENTS

| | | | |
|---|---|---|---|
| JP | S57167380 | A | 10/1982 |
| JP | H01310278 | A | 12/1989 |
| JP | H03292862 | A | 12/1991 |
| JP | 0611230 | A | 1/1994 |
| JP | H1026456 | A | 1/1998 |
| WO | 8302832 | A1 | 8/1983 |
| WO | 9946154 | A1 | 9/1999 |
| WO | 0125701 | A1 | 4/2001 |
| WO | 02076850 | A1 | 10/2002 |

OTHER PUBLICATIONS

International Search Report and Written Opinion for International Patent Application No. PCT/US2021/054515, mailed Feb. 1, 2022, 15 pages.
Non-Final Office Action for U.S. Appl. No. 17/499,199, mailed Nov. 4, 2022, 12 pages.
International Search Report and Written Opinion for International Patent Application No. PCT/US2022/036675, mailed Oct. 17, 2022, 13 pages.
International Search Report and Written Opinion for International Patent Application No. PCT/US2022/043699, mailed Nov. 28, 2022, 18 pages.
1Final Office Action for U.S. Appl. No. 17/499,199, mailed Apr. 14, 2023, 17 pages.
Advisory Action for U.S. Appl. No. 17/499,199, mailed Aug. 11, 2023, 4 pages.
Non-Final Office Action for U.S. Appl. No. 17/499,199, mailed Aug. 23, 2023, 20 pages.
First Office Action for Chinese Patent Application No. 202080092062.3, mailed Oct. 19, 2023, 11 pages.
Final Office Action for U.S. Appl. No. 17/499,199, mailed Dec. 1, 2023, 20 pages.
Non-Final Office Action for U.S. Appl. No. 17/861,796, mailed Dec. 6, 2023, 20 pages.
Final Office Action for U.S. Appl. No. 17/499,199, mailed Apr. 17, 2024, 21 pages.
Second Office Action for Chinese Patent Application No. 202080092062.3, mailed Apr. 10, 2024, 17 pages.
Notification to Grant for Chinese Patent Application No. 202080092062.3, mailed Jul. 22, 2024, 4 pages.
Office Action for Vietnamese Patent Application No. 1-2022-04701, mailed Jun. 25, 2024, 4 pages.
Final Office Action for U.S. Appl. No. 17/861,796, mailed Jul. 18, 2024, 23 pages.

* cited by examiner

THERMOELECTRIC REFRIGERATED/FROZEN PRODUCT STORAGE AND TRANSPORTATION COOLER

RELATED APPLICATIONS

This application claims the benefit of provisional patent application Ser. No. 62/953,771, filed Dec. 26, 2019, the disclosure of which is hereby incorporated herein by reference in its entirety.

FIELD OF THE DISCLOSURE

The present disclosure relates to thermoelectric cooling of a portable container.

BACKGROUND

Management of perishable goods from retail and online services requires the use of large and expensive, fixed temperature control rooms. This can be inefficient in both logistical demands and energy consumption. Thus, there is a need for systems and methods to provide a solution to this problem.

SUMMARY

Systems and methods for thermoelectric refrigerated/frozen product storage and transportation are provided. In some embodiments, a cooler (e.g., for food or other perishable item storage) includes active thermoelectric cooling (TEC) to maintain internal temperature within cold chain or customer requirements. This cooler with active TEC tooling is also referred to herein as an "active cooler". In some embodiments, the active cooler is used for storage and transportation of refrigerated and frozen food stuffs, medical or biological products, or the like. The active cooler maintains stable and uniform temperature control, powered via wall power, battery, or wireless power transmission.

In some embodiments, a drop in module (e.g., removable/replaceable) can convert any insulated box to active cooling (e.g., a freezer). In some embodiments, this can be a commercial transport tote that provides high efficiency. In some embodiments, the control logic can be enabled as an application programming interface (API) o offer remote monitoring/control to utilize on board, wireless, and networked. In some embodiments, a use profile can be customized. In some embodiments, a subscription software package can enable this. In some embodiments, the solutions described herein can be used across the whole commercial spectrum and can be ready to integrate into large quantity fleet systems.

In some embodiments, an active cooler includes a container; a lid attached to the container such that the lid can be opened to access an interior of the container and closed to seal the container; and a thermal assembly comprising a thermoelectric heat pump operable to actively cool the interior of the container.

In some embodiments, the thermal assembly further comprises processing circuitry configured to control the thermoelectric heat pump in accordance with a control scheme.

In some embodiments, the processing circuitry is configured to control the thermoelectric heat pump in accordance with the control scheme to maintain a desired setpoint temperature within the interior of the container.

In some embodiments, the processing circuitry is configured to offer remote monitoring and/or control.

In some embodiments, the processing circuitry is configured to offer remote monitoring and/or control for one or more of the group consisting of: on board access, wireless access, and networked access.

In some embodiments, the thermal assembly further comprises a heat accept system and a heat reject system.

In some embodiments, the heat accept system comprises components for transferring heat from an interior of the active cooler to a cold side of the thermal assembly and the heat reject system comprises components for transferring heat from a hot side of the thermal assembly to the ambient environment.

In some embodiments, the active cooler also includes circuitry for receiving power from a wired power source and/or from a wireless power source via wireless power transfer.

In some embodiments, the active cooler also includes automated storage and retrieval system interaction features that enable interaction between the active cooler and a storage and retrieval system dock.

In some embodiments, the thermal assembly comprises a removable module.

In some embodiments, a removable module includes: a thermal assembly comprising a thermoelectric heat pump operable to actively cool an interior of a container; where the removable module can convert any insulated box to active cooling.

In some embodiments, the thermal assembly also includes processing circuitry configured to control the thermoelectric heat pump in accordance with a control scheme.

In some embodiments, the processing circuitry is configured to control the thermoelectric heat pump in accordance with the control scheme to maintain a desired setpoint temperature.

In some embodiments, the processing circuitry is configured to offer remote monitoring and/or control.

In some embodiments, the processing circuitry is configured to offer remote monitoring and/or control for one or more of the group consisting of: on board access, wireless access, and networked access.

In some embodiments, the thermal assembly further comprises a heat accept system and a heat reject system.

In some embodiments, the heat accept system comprises components for transferring heat from an interior to a cold side of the thermal assembly and the heat reject system comprises components for transferring heat from a hot side of the thermal assembly to the ambient environment.

In some embodiments, the removable module also includes circuitry for receiving power from a wired power source and/or from a wireless power source via wireless power transfer.

In some embodiments, the removable module also includes automated storage and retrieval system interaction features that enable interaction between the removable module and a storage and retrieval system dock.

In some embodiments, the removable module also includes a container.

In some embodiments, a method of operating a removable module comprising a thermal assembly comprising a thermoelectric heat pump operable to actively cool an interior of a container, where the removable module can convert any insulated box to active cooling. The method includes: being installed in a container; and controlling the thermoelectric heat pump in accordance with a control scheme.

In some embodiments, the method also includes controlling the thermoelectric heat pump in accordance with the control scheme to maintain a desired setpoint temperature within the interior of the container.

In some embodiments, the method also includes offering remote monitoring and/or control of the removable module. In some embodiments, offering remote monitoring and/or control of the removable module comprises one or more of the group consisting of: offering on board access, offering wireless access, and offering networked access.

In some embodiments, the method also includes transferring heat from an interior of the container to a cold side of the thermal assembly; and transferring heat from a hot side of the thermal assembly to the ambient environment.

In some embodiments, the method also includes receiving power from a wired power source and/or from a wireless power source via wireless power transfer.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
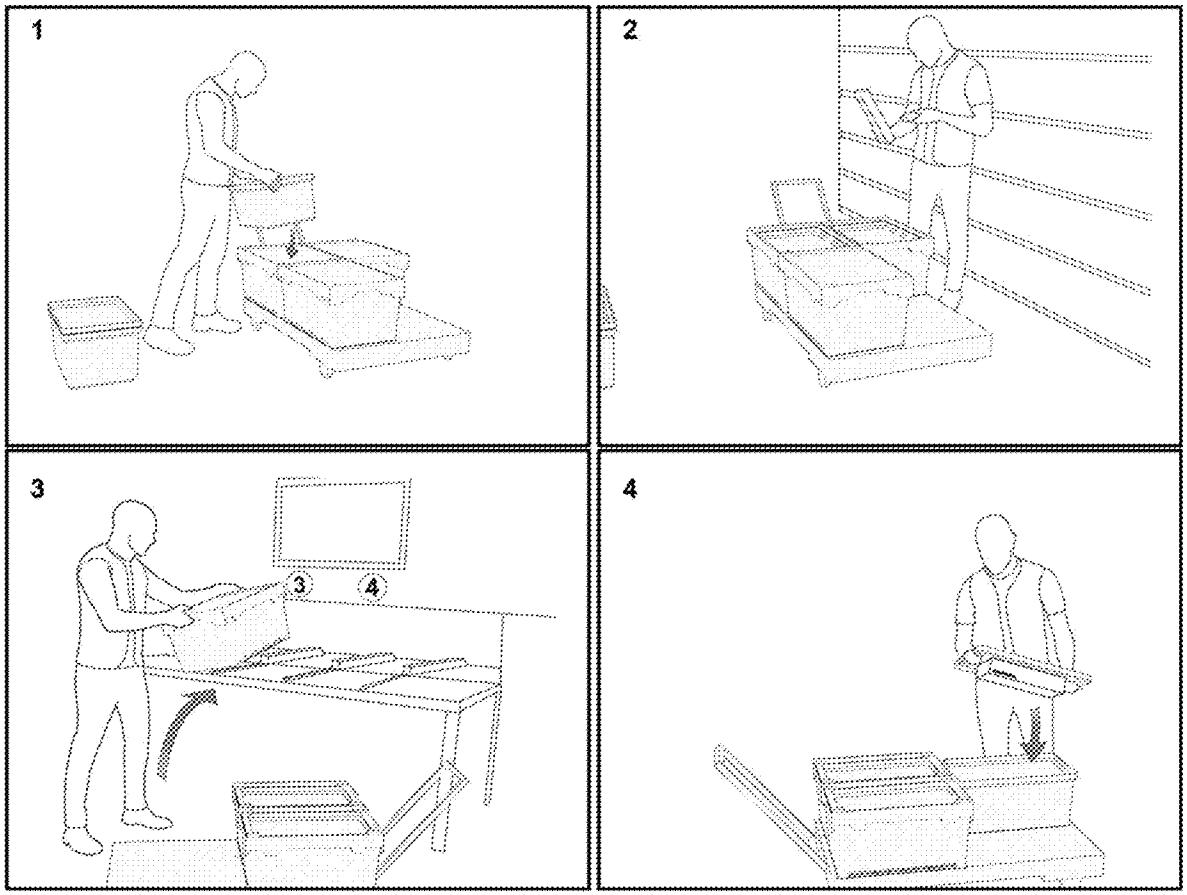
FIG. 1 illustrates utilization of a portable, self-contained, refrigeration or freezing system, coupled with integrated automated controls and monitoring.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It should be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It should also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It should be understood that, although the terms "upper," "lower," "bottom," "intermediate," "middle," "top," and the like may be used herein to describe various elements, these elements should not be limited by these terms.

These terms are only used to distinguish one element from another. For example, a first element could be termed an "upper" element and, similarly, a second element could be termed an "upper" element depending on the relative orientations of these elements, without departing from the scope of the present disclosure.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having meanings that are consistent with their meanings in the context of this specification and the relevant art and will not be interpreted in an idealized or overly formal sense unless expressly so defined herein.

Management of perishable goods from retail and online services requires the use of large and expensive, fixed temperature control rooms. This can be inefficient in both logistical demands and energy consumption. Utilization of a portable, self-contained, refrigeration or freezing system, coupled with integrated automated controls and monitoring, can significantly improve the flexibility of merchant perishable inventory management from incoming deliveries through retail display, warehousing, curbside pickup, and home delivery, without compromising food safety and simultaneously eliminating waste and food spoilage.

FIG. 1 illustrates utilization of a portable, self-contained, refrigeration or freezing system, coupled with integrated automated controls and monitoring. In some embodiments, containers with goods can be loaded into other containers. These containers can be wirelessly controlled and tracked. In some embodiments, these containers can be attached to inventory control areas and/or areas that provide power to the containers. In some embodiments, a removable module can include the thermoelectric device and associated control mechanisms. This can be added to an insulated container to provide active cooling.

Current methods for commercial refrigerated/frozen food storage and transportation in grocery, supply chain, delivery, and other food cold chain applications are:

Large scale cooling of warehouse location using conventional HVAC to cold chain compliant temperatures.

In comparison, thermoelectric commercial refrigerated/frozen food storage enables point of need cold chain compliance, efficient use of space, and ability to maintain active cold chain compliance while transporting goods outside of the warehouse.

Ice packs in insulated coolers used for short term food transport and storage. These risk hot/cold spots within the storage volume, and unmonitored excursions from cold chain compliance.

In comparison, thermoelectric commercial refrigerated/frozen food storage enables constant monitoring of cold chain compliance and stable and uniform temperature control throughout the storage space.

A cooler (e.g., for food or other perishable item storage) with active thermoelectric (TEC) cooling to maintain internal temperature within cold chain or customer requirements is disclosed herein. This cooler with active TEC cooling is also referred to herein as an "active cooler". In some embodiments, the active cooler is used for storage and transportation of refrigerated and frozen food stuffs, medical or biological products, or the like. The active cooler maintains stable and uniform temperature control, powered via wall power, battery, or wireless power transmission.

Figure 2:
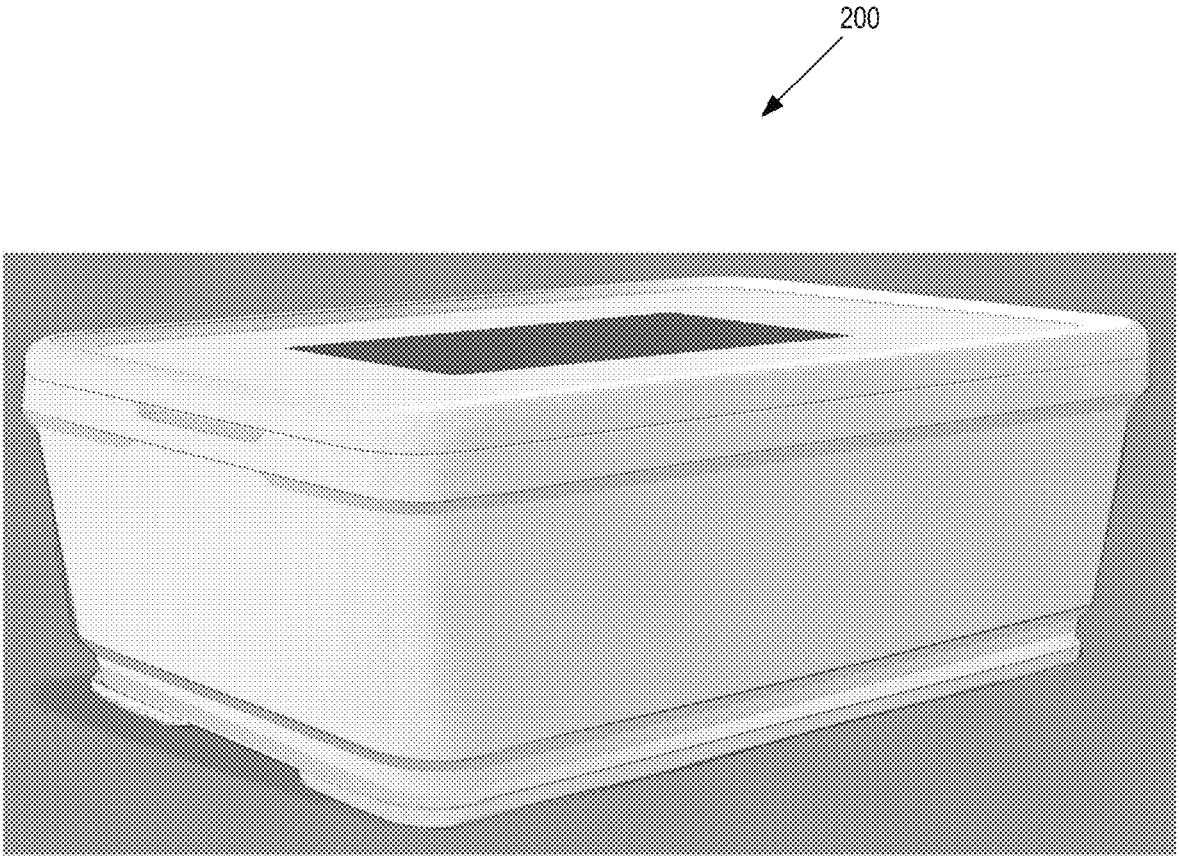
FIG. 2 and FIGS. 3A and 3B illustrate an example embodiment of an active cooler in accordance with embodiments of the present disclosure.
Figure 3A:
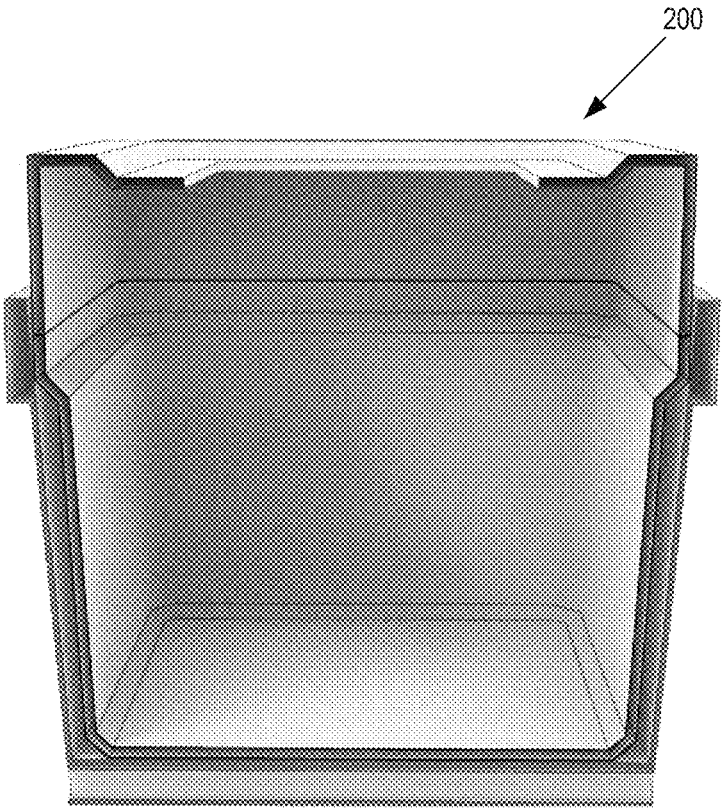
Figure 3B:
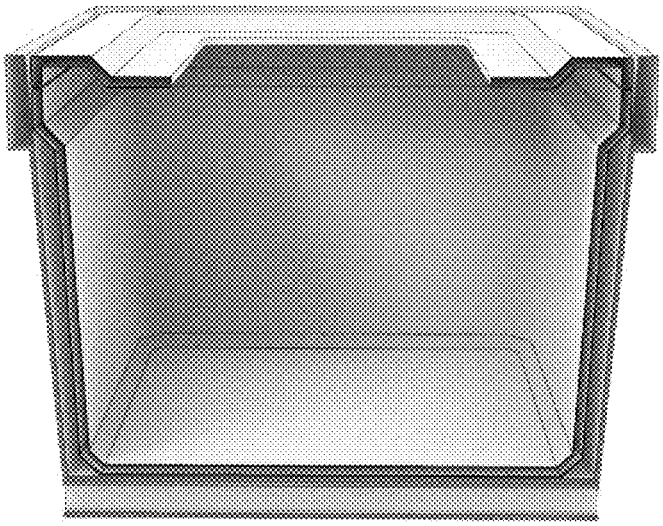

One example embodiment of the active cooler is illustrated in FIG. 2 and FIGS. 3A and 3B. FIG. 2 illustrates an active cooler 200 that could be a removable module including a thermal assembly including a thermoelectric heat pump operable to actively cool the interior of the container. The removable module can convert any insulated box to active cooling.

Figure 4:
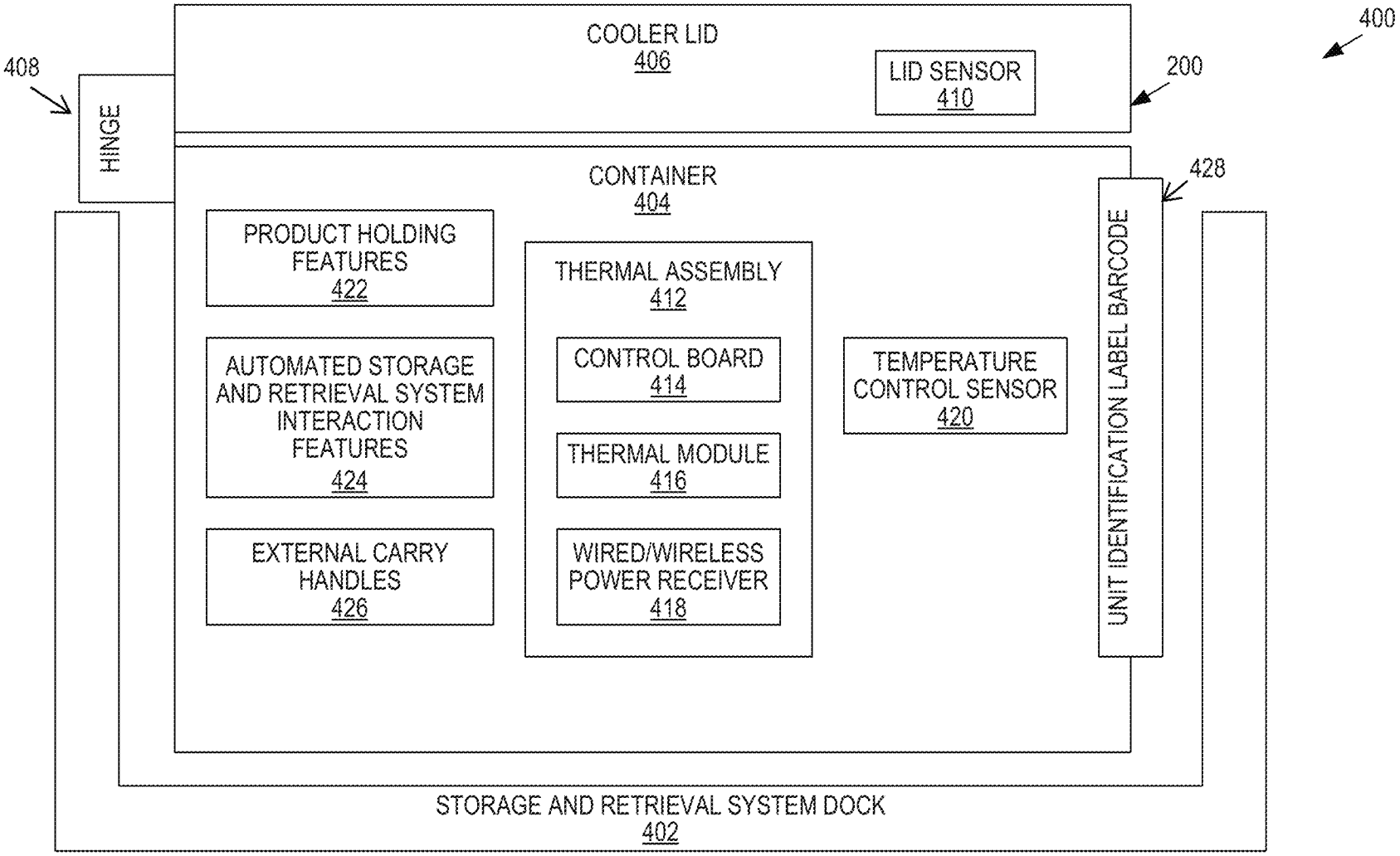
FIG. 4 illustrates a system including an active cooler in accordance with some embodiments of the present disclosure.

A schematic diagram of a system 400 including the active cooler 200 and a storage and retrieval system dock 402 in accordance with one embodiment of the present disclosure is illustrated in FIG. 4. As illustrated, the active cooler 200 includes the following components. Note that in some alternative embodiments, the active cooler 200 may not include all of the illustrated components or may include additional or alternative components not illustrated in FIG. 4. The components of the example of the active cooler 200 illustrated in FIG. 4 are:

Container 404: The container 404 (also referred to herein as the "tote" container 404) is an insulated container in which an item(s) to be cooled is placed. The walls of the container 404 may be insulated using an desired insulation (e.g., foam).

Lid 406: The lid 406 is attached to the container 404 via, in this example, hinge 408. The lid 406 can opened and closed to place an item(s) into the container 404 or to remove item(s) from the container 404.

Hinge 408: The hinge 408 attaches the lid 406 to the container 404 such that the lid 406 can be opened and closed, as described above.

Lid Sensor 410: The lid sensor 410 is a senor that senses when the lid 406 is open or closed. An output of the lid sensor 410 is provided to thermal assembly 412 via a wired or wireless connection. The output of the lid sensor 410 may, for example, be used in a control scheme implemented by the thermal assembly 412 to control a TEC used to maintain a desired setpoint temperature within the active cooler 200.

Thermal Assembly 412:

Control Board 414: The control board 414 includes electronics (e.g., a processor(s) such as an Application Specific Integrated Circuit (ASIC), Central Processing Unit (CPU), Field Programmable Gate Array (FPGA), and/or the like as well as Digital to Analog (D/A) converter(s) or similar circuitry to drive the TEC under the control of the processor(s) (e.g. via converting digital output signal from the processor(s) to a corresponding analog signal) in accordance with the control scheme). The control scheme may take into consideration the output of the lid sensor 410 as well as output(s) from temperature sensor(s) within the container 404. The control scheme uses such inputs to control the TEC such that the desired setpoint temperature is maintained within the container 404. In some embodiments, the control scheme includes one or more of the control schemes described in U.S. Patent Application Publication US 2013/0291555, U.S. Patent Application Publication US 2015/0075184, U.S. Pat. Nos. 9,581,362, 10,458,683, and 9,593,871, which are in incorporated herein by reference.

Thermal Module 416: The thermal module 416 includes the TEC as well as various heat transfer components for extracting heat from the container 404 and rejecting the extracted heat to the ambient environment (i.e., the environment external to the active cooler 200). In some embodiments, the thermal module 416 includes a heat pump such as that described in U.S. Pat. No. 9,144,180, which is incorporated herein by reference. For heat extraction (i.e., heat accept) and heat rejection, the thermal module 416 may include, for example, a heat accept system (e.g., thermosiphons or other passive or active heat exchange component(s) for transferring heat from an interior of the active cooler 200 to a cold side of the TEC/heat pump) and a heat reject system (e.g., thermosiphons or other active or passive heat exchange components for transferring heat from a hot side of the TEC/heat pump to the ambient environment).

Wireless/Wired Power Receiver 418: The wireless/wired power receiver 418 includes circuitry for receiving power from a wired power source (e.g., a power outlet or a battery) or from a wireless power source via wireless power transfer.

Temperature Control Sensor 420: The temperature control sensor 420 is a sensor that senses the temperature within the active cooler 200 and provides a signal indicative of this temperature to the thermal assembly 412 for use by the control board 414 to implement the control scheme.

Product Holding Features 422: The product holding features 422 are features (e.g., tray(s), rack(s), etc.) that hold the desire item(s) within the container 404.

Automated Storage and Retrieval System Interaction Features 424: The automated storage and retrieval system interaction features 424 are features (e.g., electronics) that enable interaction between the active cooler 200 and the storage and retrieval system dock 402 (e.g., to enable setting of the desired setpoint temperature, e.g., via a user, to enable reporting of the internal temperature of the active cooler 200, or the like).

External Carry Handles 426: The external carry handles 426 are handles that enable carrying of the active cooler 200 by a user and/or by some automated system for moving the active cooler 200, e.g., within a warehouse.

Unit Identification Label Barcode 428: The unit identification label barcode 428 is a barcode label that enables identification of this particular active cooler 200.

In some embodiments, the active cooler 200 is an active insulated cooler that features a thermoelectric cooler (e.g., a TEC assembly installed directly into the cooler 200 in a removable or built-in module (e.g., the thermal module 416)).

In some embodiments, cold chain compliance is maintained by active monitoring and control of thermoelectric assembly (e.g., active monitoring and control of the thermoelectric assembly 412).

In some embodiments, the active cooler 200 achieves temperatures down to 1° C.

In some other embodiments, the active cooler 200 achieves temperatures down to −22° C.

In some embodiments, cold side thermal transport from the active cooler 200 (e.g., thermal transport from the interior of the active cooler 200 to the cold side of the TEC/heat pump) is accomplished through a forced convection or cold wall "accept" circuit. In some embodiments, $CO_2$ is used as a refrigerant.

In some embodiments, heat from the cooled chamber (e.g., heat from the interior of the air cooler 200) and power supply is rejected (e.g., from the hot side of the TEC/heat pump) through a finned heat pipe heat exchanger. In some embodiments, water is used as the refrigerant. In some embodiments, air from a fan is moved over the finned heat pipe heat exchanger.

In some embodiments, a phase change material thermal energy storage system is optionally incorporated into the walls of the cooler to preserve the contents for prolonged periods of transportation and storage with the cooling system turned off.

In some embodiments, an insulated cover for the cold side accept heat exchanger is optionally used to improve the temperature holding capability of the active cooler 200 in the off state.

In some embodiments, internal ducting is included for directing airflow to achieve a consistent and uniform temperature distribution within the cooled chamber.

In some embodiments, the active cooler 200 incorporates coatings and seals to protect against moisture and allow safe exposure to outdoor weather conditions such as hot air and light rain.

In some embodiments, the active cooler 200 is capable of communication to a supervisory system via Wifi, Bluetooth, or Near-Field Communication technologies but not limited to these technologies. This supervisory system may include the dock 402 of FIG. 4.

In some embodiments, the active cooler 200 has fault diagnostic and reporting capability to a supervisory system to reduce maintenance (e.g., via the automated storage and retrieval system interaction features 424).

In some embodiments, temperature data for cold chain compliance is tracked and stored locally and/or wirelessly. Battery powered operation allows continuous temperature tracking including during transportation.

In some embodiments, the active cooler 200 is compatible with one or more warehouse automated or manual storage and retrieval systems. In some embodiments, automated systems can manage the number of active coolers 200 that are activated (i.e., in use) and the temperature setting for each activated active cooler 200. In some embodiments, the active cooler 200 includes onboard diagnostics to provide real time feedback on the status and temperature (i.e., internal temperature) of the active cooler 200. In some embodiments, the active cooler 200 (e.g., the control board 414) generates error messages and communicates the error messages (e.g., communicates the error messages to the dock 402 or to some central system via the dock 402, communicates the error messages using an desired wired or wireless network interface, or communicates the error messages via an onboard indicator, e.g., an indicator that is visible to a person visually inspecting the active cooler 200) as they arise.

Figure 5:
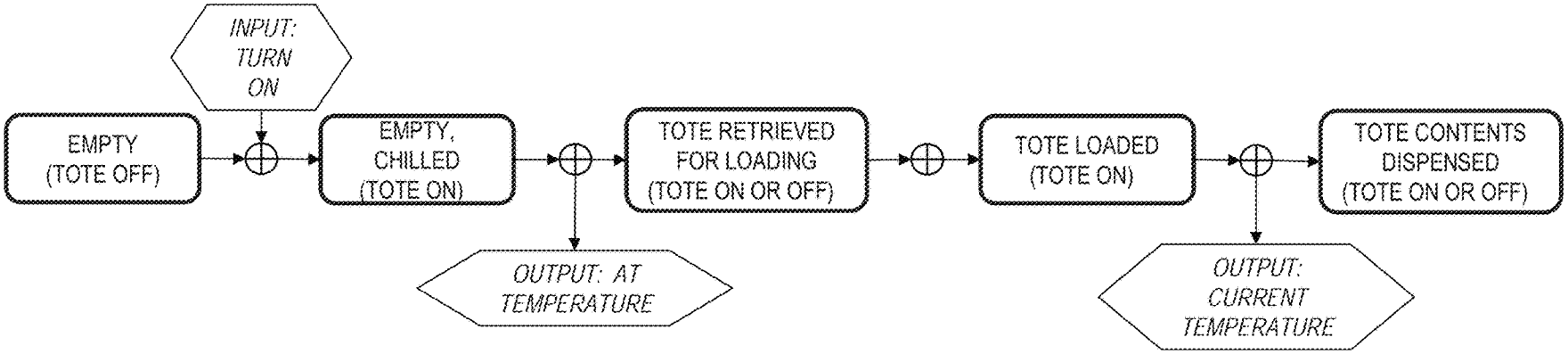
FIG. 5 is a flow chart for communication and control of an active cooler in accordance with some embodiments of the present disclosure.

FIG. 5 is a flow chart that illustrates a procedure for communication and control of the active cooler 200 in accordance with one example embodiment of the present disclosure.

Tote Usage

Totes (i.e., active coolers 200) are intended to be stored in a powered down state until demand dictates that refrigerator or freezer space is needed. This can provide farms, retail clerks, warehousing or storage systems the capability to have their maximum amount of temperature-controlled space or no temperature-controlled space, as needed by demand. A manual user can locally activate a tote 200, or a central control system can demand the desired capacity to initialize as dictated by a desired control scheme (e.g., IoT algorithms) or direct demand. When the tote 200 reaches the desired set point, it can report locally with visual and or audible alerts and/or report through the network, that it is ready for use. This architecture allows for the most efficient use of space and energy in inventory storage, retail display and customer-order management. Totes 200 can have onboard battery systems that allow for extended off-grid operation, facilitating communications, transport pick-up and delivery services.

Modular Dock

The modular docking system (e.g., a modular system including docks 402) is able to accommodate installations in manual carts, transport vehicles, retail shelving, warehousing racks, automated storage and retrieval systems, Customer Home Kiosks, or the like. All of these systems potentially have the capability to physically secure, power, charge and communicate with the tote 200 through a network connection and report to a central control system. This capability will facilitate the expansion of use case from single-mode operation to multi-purpose mode as adoption expands. In some embodiments, the dock/racking system (e.g., dock 402) provides primary power, either wired or wireless, as well as charging capabilities for onboard battery systems. The dock 402 can act as a power conversion system when necessary to accommodate a wider variety of input power sources. The dock 402 can also serve as a wired network interface and extended range wireless interface that will periodically poll the tote for status and report it to a central control system.

Manual Carts:

Manual carts can be used to transport the totes 200 as a single unit or multi tote array. A battery system can provide extended power to the entire array. These carts can be used outdoors or indoors as needed to facilitate harvest or order collection in a retail setting. The carts will be able to provide extended battery operation for all onboard totes if needed.

Transport Vehicles:

Vehicles transporting inventory or custom orders can be integrated with modular tote storage or racking. These systems may be integrated into a power and network system that is either self-contained or fully integrated into the vehicle power system. This provides indefinite temperature holdover to enable extended range delivery to and from the retail or warehousing location.

Retail Shelving:

Retail shelving can be integrated with the docking system to allow for bulk item display for perishable goods. These can be incorporated in specialty locations as well as end-cap or mid-aisle locations.

Warehousing Racks:

Central warehousing racks can be integrated with the docking system to provide localized temperature-controlled space in any available slot vs. central refrigerated and freezer space. This would enable a more efficient use of space as well as workflow for customer orders to be able to be kept in a single location, reducing the risk of ordering/delivering mistakes Automated Storage and Retrieval Systems:

Automated inventory and order management systems will be able to better utilize space as needed for standard and perishable items within their limited available spaces. Coupled with centralized control and monitoring, this will enable the most efficient use of space and minimal energy consumption while allowing for coordination of both longer term product storage as well as customer orders to be stored within the same system, while minimizing risk of mistakes or mix-ups when being pulled from storage and into retrieval.

Customer Home Kiosks:

Home delivery Kiosks can allow for compatible docking stations to provide indefinite temperature control for perishable goods. The use of customer Kiosks can enable unattended delivery. This can greatly increase the efficiency and effectiveness of home delivery services by not requiring a person to be at home when the deliveries are being made, while insuring that perishable items are not lost or ruined.

Embodiment 1: An active cooler (200), comprising: a container (404); a lid (406) attached to the container (404) such that the lid (406) can be opened to access an interior of the container (404) and closed to seal the container (404); and a thermal assembly (412) comprising a thermoelectric heat pump operable to actively cool the interior of the container (404).

Embodiment 2: The active cooler (200) of embodiment 1 wherein the thermal assembly (414) comprising processing circuitry configured to control the thermoelectric heat pump in accordance with a control scheme.

Embodiment 3: The active cooler (200) of embodiment 2 wherein the processing circuitry is configured to control the thermoelectric heat pump in accordance with the control scheme to maintain a desired setpoint temperature within the interior of the container (404).

Embodiment 4: The active cooler (200) of any of embodiments 1 to 3 wherein the thermal assembly (412) further comprises a heat accept system and a heat reject system.

Those skilled in the art will recognize improvements and modifications to the preferred embodiments of the present disclosure. All such improvements and modifications are considered within the scope of the concepts disclosed herein and the claims that follow.

What is claimed is:

1. An active cooler, comprising:

a container;

a lid attached to the container such that the lid can be opened to access an interior of the container and closed to seal the container;

a thermal assembly comprising a thermoelectric heat pump operable to actively cool the interior of the container, the thermal assembly comprising:

circuitry for receiving power from one or more of the group consisting of: a wired power source; and a wireless power source via wireless power transfer; and processing circuitry configured to control the thermoelectric heat pump in accordance with a control scheme, the processing circuitry being configured to offer one or more of the group consisting of: remote monitoring; and control;

automated storage and retrieval system interaction features that enable interaction between the container and a storage and retrieval system dock where the storage and retrieval system dock is integrated with a home delivery kiosk; and one or more external electrical connections for accepting power from the storage and retrieval system dock.

2. The active cooler of claim 1 wherein the processing circuitry is configured to control the thermoelectric heat pump in accordance with the control scheme to maintain a setpoint temperature within the interior of the container.

3. The active cooler of claim 1 wherein the processing circuitry is configured to offer the one or more of the group consisting of: remote monitoring; and control for one or more of the group consisting of: on board access, wireless access, and networked access.

4. The active cooler of claim 1 wherein the thermal assembly comprises a removable module.

5. The active cooler of claim 1 wherein the automated storage and retrieval system interaction features enable interaction between the container and a second storage and retrieval system dock integrated with a vehicle for transporting inventory.

6. A removable module, comprising:

a thermal assembly comprising a thermoelectric heat pump operable to actively cool the interior of a container, the thermal assembly comprising:

circuitry for receiving power from one or more of the group consisting of: a wired power source; and a wireless power source via wireless power transfer; and processing circuitry configured to control the thermoelectric heat pump in accordance with a control scheme, the processing circuitry being configured to offer one or more of the group consisting of: remote monitoring; and control;

automated storage and retrieval system interaction features that enable interaction between the container and a storage and retrieval system dock where the storage and retrieval system dock is integrated with a home delivery kiosk; and one or more external electrical connections for accepting power from the storage and retrieval system dock;

where the removable module is capable of converting an insulated box to active cooling.

7. The removable module of claim 6 wherein the processing circuitry is configured to control the thermoelectric heat pump in accordance with the control scheme to maintain a setpoint temperature.

8. The removable module of claim 6 wherein the processing circuitry is configured to offer the one or more of the group consisting of: remote monitoring; and control for one or more of the group consisting of: on board access, wireless access, and networked access.

9. The removable module of claim 6 wherein the automated storage and retrieval system interaction features enable interaction between the container and a second storage and retrieval system dock integrated with a vehicle for transporting inventory.

10. A method of operating a removable module comprising a thermal assembly comprising: a thermoelectric heat pump operable to actively cool the interior of a container; circuitry for receiving power from one or more of the group consisting of: a wired power source; and a wireless power source via wireless power transfer; processing circuitry configured to control the thermoelectric heat pump in accordance with a control scheme, the processing circuitry being configured to offer one or more of the group consisting of: remote monitoring; and control; and automated storage and retrieval system interaction features that enable interaction between the container and a storage and retrieval system dock where the storage and retrieval system dock is integrated with a home delivery kiosk; where the removable module is capable of converting an insulated box to active cooling and the removable module comprises one or more external electrical connections for accepting power from the storage and retrieval system dock, the method comprising:

being installed in the container; and controlling the thermoelectric heat pump in accordance with a control scheme.

11. The method of claim 10 further comprising:

offering one or more of the group consisting of: remote monitoring; and control of the removable module.

12. The method of claim 11 wherein offering the one or more of the group consisting of: remote monitoring; and control of the removable module comprises one or more of the group consisting of: offering on board access, offering wireless access, and offering networked access.

13. The method of claim 12 further comprising:

transferring heat from the interior of the container to a cold side of the thermal assembly; and transferring heat from a hot side of the thermal assembly to the ambient environment.

14. The method of claim 10 wherein the automated storage and retrieval system interaction features enable interaction between the container and a second storage and retrieval system dock integrated with a vehicle for transporting inventory.

* * * * *